US009340317B2

(12) United States Patent
Whiteside et al.

(10) Patent No.: US 9,340,317 B2
(45) Date of Patent: May 17, 2016

(54) RECYCLABLE CONTAINER BLANK AND METHOD OF FORMING A SHIPPING PACK HAVING ARTICLES SECURED THEREIN

(75) Inventors: Andrew David Whiteside, Bungay (GB); Alistair Fraser Moore, Bungay (GB)

(73) Assignee: Smart Karton Worldwide LLC, St. Charles, MD (US)

( * ) Notice: Subject to any disclaimer, the term of this patent is extended or adjusted under 35 U.S.C. 154(b) by 563 days.

(21) Appl. No.: 13/500,638

(22) PCT Filed: Oct. 5, 2010

(86) PCT No.: PCT/GB2010/001892
§ 371 (c)(1), (2), (4) Date: Jul. 6, 2012

(87) PCT Pub. No.: WO2011/042707
PCT Pub. Date: Apr. 14, 2011

(65) Prior Publication Data
US 2012/0267425 A1 Oct. 25, 2012

(30) Foreign Application Priority Data
Oct. 5, 2009 (GB) ..... 0917366.7

(51) Int. Cl.
*B65D 5/50* (2006.01)

(52) U.S. Cl.
CPC ..... *B65D 5/5028* (2013.01); *B65D 2313/10* (2013.01)

(58) Field of Classification Search
CPC .... B65D 5/5028; B65D 5/5035; B65D 5/606; B65D 81/07
USPC ..... 229/164.2, 101, 103.2, 103.3, 117.27; 206/594, 478, 565, 591, 592, 433, 521, 206/526
See application file for complete search history.

(56) References Cited

U.S. PATENT DOCUMENTS

| | | | | |
|---|---|---|---|---|
| 4,328,896 | A * | 5/1982 | Behne | 206/497 |
| 4,757,900 | A * | 7/1988 | Misset et al. | 206/497 |
| 5,086,925 | A * | 2/1992 | Coalier et al. | 206/497 |
| 5,393,291 | A * | 2/1995 | Wingerter | 493/116 |
| 5,566,827 | A * | 10/1996 | Janhonen | 206/424 |
| 2002/0134052 | A1 * | 9/2002 | Bernardo | 53/440 |
| 2003/0197051 | A1 * | 10/2003 | Muise et al. | 229/117.32 |
| 2005/0079965 | A1 * | 4/2005 | Moshier et al. | 493/52 |
| 2008/0210591 | A1 * | 9/2008 | Cheich | 206/594 |

FOREIGN PATENT DOCUMENTS

FR 2853885 B1 * 8/2006

OTHER PUBLICATIONS

Machine Translation of FR 2853885.*

* cited by examiner

*Primary Examiner* — Christopher Demeree
*Assistant Examiner* — Phillip Schmidt
(74) *Attorney, Agent, or Firm* — Simana Rao, Esq.; McNeely, Hare & War LLP

(57) ABSTRACT

A container blank (1) of the RSC type having a material web (2) attached thereto to retain an article within a container formed from the blank (1). The web material (2) is selected from one or more materials having substantially identical recycling characteristics to the material from which the blank (1) is formed. The web material is coated in a cohesive film and can be stacked and handled without tack.

24 Claims, 7 Drawing Sheets

RECYCLABLE CONTAINER BLANK AND METHOD OF FORMING A SHIPPING PACK HAVING ARTICLES SECURED THEREIN

CROSS-REFERENCE TO RELATED APPLICATIONS

This application claims priority from PCT/GB2010/001892, filed on Oct. 5, 2010, and published as WO 2011/042707 (published on Apr. 14, 2011) and which claims priority from GB 0917366.7 filed on Apr. 5, 2009, the contents of each of which are incorporated herein in their entirety by reference.

FIELD OF THE INVENTION

The present invention relates to a container blank and a method of forming a container for use in packaging articles, particularly the packaging of single or multiple upright or irregularly shaped articles such as beverage, condiment or shampoo and shower gel bottles, machine parts and vehicles spares. In general, the invention is directed to the packaging of non-flat articles for which there are numerous specifically designed containers, for example, for books or video cassettes and discs, such as CDs and DVDs. The invention also relates to a shipping pack (that is, including packaged articles) formed using the container blank of the invention. The invention also relates to the method used to shape the blank into a package for constraining at least one article therein for dispatch (shipping) or storage.

The invention particularly relates to a container blank made of card and cardboard or similar material, the blank being modified to include an article retaining means to secure articles therein and prevent damage-causing movement within the container formed from the blank. Additionally, the invention relates to a method of manipulating the blank firstly to form a receptacle for an article to be shipped and to constrain the at least one article therein before subsequently sealing the container to form a pack for dispatch (shipping) or storage. The invention is described hereinbelow with reference to non-flat articles such as those exemplified above, however it should be appreciated that no such limitation exists.

It will be appreciated by the skilled addressee that the invention, although directed towards the packaging of upright and irregularly shaped articles, may be applied to any three-dimensional object locatable within the container and is not limited to similarly shaped articles such as beverage or condiment bottles. The invention may also be used for the packaging and shipping of stacks of flat articles such as books and DVDs.

BACKGROUND TO THE INVENTION

Increasingly, customers are eschewing the time-consuming routine of travelling to purchase their shopping and/or personal and business needs. It is now common for purchases to be made by mail order, telephone and via the Internet and email. As a consequence, for goods to be received there is a marked increase in the use of postal and courier services to deliver the purchases.

The further involvement of postal services and other delivery systems is different from the traditional mode of shopping where the customer travels to purchase articles over the counter and returns using public or their own transport means. In this scenario, packing or packaging is done at the counter or before the customer leaves, after which responsibility for damage no longer resides with the seller. As most postal and courier services either limit their liability for damage to articles delivered by them or charge significant premiums for insurance against such damage, it falls to the retailer, warehouseman or company dispatching the purchase to ensure there is minimal risk of damage during transit to the customer. The term "postal" as used herein is intended as a convenient expression of all local, national and international dispatch and courier services, including drop-shipping services and terms "dispatch" and "shipping" are used interchangeably.

With the increased popularity of Internet shopping and the dispatch of ordered articles via the postal system the requirement for packaging has increased manyfold. The popularity of such websites as Amazon™ and eBay™ have increased the postal traffic of books, CDs, CDROMs and DVDs amongst others. Also with costs associated with deliveries, many machine parts and vehicle spares, including bulky and awkwardly shaped items, such as vehicle light clusters, are dispatched via courier rather than parts providers running their own delivery service, as was common in the past. Due to the vast turnover of dispatched articles and the inherent risks associated with the bulk handling of goods, there is a market requirement for sturdy containers. Additionally, as the volume of mail order catalogue business increases so to does the volume of returns. This has a severe consequence on the profitability of the mail order transaction and, where the returned article is damaged, the customer must bear responsibility for the damage. This condition of sale often has repercussions for customer relationships.

In other words, a fundamental requirement of any method of goods transportation is that the goods are not damaged during transport so that they reach their destinations in a non-damaged state.

It has been found in practice, that the packaging of articles such as bottles, machine parts and vehicle spares and similar articles having at least one dimension substantially greater than the others has presented, in terms of packaging, a significant ongoing problem. This problem manifests itself particularly in situations where the articles are packaged on a production line basis using a packaging method involving the folding of a cardboard like blank into a container for receiving an article to be packed.

Containers formed from blanks made of card and cardboard and other materials suitable for dispatch through the postal services are well known in the prior art. Generally, the containers are formed from a relatively simple blank having multiple cut-aways to define a blank having side walls separated by fold lines and one or more base and lid portions connected to one or more of the side walls by corresponding fold lines. Commonly, to construct the container, an end tab of one side wall is secured to an edge portion of another side wall and the or each base portion is folded and secured to form an open-mouthed container. When the or each article to be dispatched has been placed within the container, the or each lid portion is folded and secured. The means of securing the portions to form the container is normally selected from gluing, stapling or applying adhesive tape.

It will be appreciated that unless the container is designed to receive the specific article(s) to be dispatched, further packaging materials will be required to prevent the article(s) moving about within the container. In the packaging industry generally there is a move to obviate extraneous packaging materials and in some countries there are regulations and legislation to prevent wasteful packaging practices.

The invention is directed to overcoming some of the established disadvantages associated with prior art containers, particularly those realising a container which is adapted for encapsulating or otherwise securing one or more articles within the container to prevent damage due to movement within the container during transit to its destination.

In an attempt to obviate some of the disadvantages highlighted above, a solution suggested in the prior art is to utilise a web of lining material to secure the articles within the container.

One established solution is to place the articles for dispatch in a tray, usually of a cardboard material. The tray and articles are then wrapped by a web of plastics material which is subsequently heated to effect a shrink-wrapped package. Alternatively, the web or film is tensioned around the article (s) by folding elements of the tray to which the web is attached. This package is then placed into a pre-formed container which is finally sealed and marked for dispatch. This arrangement, however, has its own disadvantages including that, although the articles are bound together, the tray will often move sufficiently in the container to dislodge the articles from the tray. Furthermore, this arrangement does not avoid the use of unnecessary additional packaging materials and includes an extra stage in the packaging process.

Consequently, there is a perceived need to provide a container having an article retaining means which is adaptable to conform with the article or articles contained therein to minimise movement of the or each article within the container during transit.

In another solution, United Kingdom Patent No. GB 2 343 885 describes a container blank to which a sheet or web of lining material is secured. This lining material is shrink-wrappable so that articles may be placed directly into the container and secured in situ.

There has been an increasing awareness for the need for packaging to be easily recyclable and, although the general public are increasingly involved in the separation of recyclable and non-recyclable waste, where there is separation of materials required it is perceived as being simpler simply to discard the entire packaging for processing as non-recyclable waste. More recently, packaging legislation has pushed packaging manufacturers towards simpler and less obtrusive packaging use to cut down the volume of packaging material that is used for individual containers.

In the packaging industry, waste material generated during forming of a container blank adds significantly to the overall cost. For each blank having a section removed, an additional piece of waste material is produced and has to be handled or otherwise cleared from the blank forming site. The processing and/or removal of the accumulated waste, most often for recycling, increases the per unit cost of the blank.

It is known that in many instances, it is the cost of forming and preparing a container blank with appropriately positioned glue lines that is the most significant factor in the end cost of forming a shipping pack having the required article constrained therein.

It is an object of the present invention to minimise the cost of producing a container blank which can be formed into a sealed shipping pack.

It is an object of the present invention to alleviate the above disadvantages and to provide a packaging system that is wholly recyclable and has an article retaining means which is adaptable to conform with one or more articles contained therein.

It is also an object of the present invention to provide a method for the manipulation of a carton blank to constrain at least one article therein for dispatch or storage.

SUMMARY OF THE INVENTION

In its primary aspect, the present invention provides a container blank, so sized and shaped as to form a container having a base and side walls, there being secured therein a web of material adapted to retain an article within the container, wherein the web material is selected from one or more materials having substantially identical recycling characteristics to the material from which the blank is formed.

The present invention particularly provides a container blank comprising:

a base, side walls and a web of material adapted to retain an article within the container, the material web being secured to each of the side walls and being of sufficient height to protrude from an open-mouthed contained formed from the blank.

Conveniently, the container blank comprises a series of four segments, each having a side wall portion to which there is attached, along respective fold lines, a base element and a lid element, the segments being joined to at least one other segment by a side wall fold line wherein a material web extends over at least a part of each of the segments and defines the inner surface of the container formed from the blank.

Ideally, the material web is secured to the segments along a region adjacent the base element fold lines.

Advantageously, the material web is so sized and shaped as to extend beyond the mouth of an open-mouthed container formed from the blank.

Conveniently, the material adapted to retain an article within the container formed from the blank is a card or paper web.

Advantageously, the material web is presented so that articles to be retained within the container are placed within the base portion and the material web is then closed and tensioned to secure each article therein.

Preferably the material web has cohesive portions thereon, the portions being brought together so that the cohesive regions bond across their entire free area until the bonded section abuts the upper surface of the or each article held therein, thereby creating the constraining tension to the article (s).

Conveniently, the cohesive portion includes an adhesive adapted to adhere only to surfaces having like adhesive thereon.

Advantageously, the cohesive portions are spray coated with a cold-seal adhesive.

In a preferred construction of the container blank, an RSC type container blank has secured thereto a web of material over at least part of the side wall forming regions and extending over at least a major part of the lid forming regions.

Ideally, a strip of adhesive is applied to the blank and the material web is adhered to the blank. Optionally, the adhesive is applied to the material web.

In a preferred construction of container blank, the material web is so sized and shaped as to extend over substantially all of the side wall regions and lid forming regions. Advantageously, the web is secured to the side wall regions by a strip of adhesive adjacent the base forming region fold lines.

Although the container blank may be handled or conveyed in an open configuration, it is ideally folded so that the material web is not exposed prior to being assembled into an open-mouthed container.

In a first configuration, the free end segments are folded inwardly to overlie the inner segments, thereby presenting a substantially flat blank.

In a second configuration, the free end segments are secured together to present a rectangular tube having the material web lining the inner surface thereof, the tube being then flattened to provide a lined blank for handling or conveying.

The present invention further provides a method of forming a shipping pack from a container blank of the type having attached thereto a material web adapted to retain an article within a container formed from the blank, the material web being selected from one or more materials having substantially identical recycling characteristics to the material from which the blank is formed, the method comprising:

assembling an open-mouthed container from a container blank by folding two opposed base forming regions inwardly and subsequently folding the remaining two opposed base forming regions inwardly and securing said remaining regions in position to form a base portion;

placing one or more articles onto the base portion of the open-mouthed container;

bringing together the free ends of the material web so that cohesive regions of the web are brought together across their free surfaces and sufficient force is applied thereto to activate the adhesive and secure the or each article within the article retaining web;

closing the lid portions in an overlying relationship and sealing the lid.

Preferably, the base portion and the lid are secured using adhesive tape.

Optionally, pre-applied pressure-sensitive adhesive is used to bond the base forming regions and the lid forming regions respectively together.

Where the cohesive material web is cut along its fold lines, the free ends of two opposed web segments are brought together to overlie the or each article before the remaining cohesive segments are brought together and tension applied.

The present invention further provides an apparatus for forming a shipping pack from a container blank of the type having attached thereto a material web adapted to retain an article within a container formed from the blank, the material web being selected from one or more materials having substantially identical recycling characteristics to the material from which the blank is formed, the apparatus comprising:

a magazine from which unlined container material is fed;

an adhesive application station;

a material web feeding mechanism;

an application station where the web material is adhered to the container material to form a container blank;

a conveyor means; and a folding station where free end segments of the blank are folded along their respective fold lines and are secured together by a fixing tab.

Advantageously, the end segments are folded inwardly over their respective fold lines to overlie inner segments of the blank and are secured together in a flattened configuration by the fixing tab.

In one arrangement there is provided means for forming an open-mouthed container from a lined container blank including means for bringing together opposed base forming regions and subsequently folding the two remaining opposed base forming regions inwardly and securing said remaining regions in position to form a base.

Conveniently, means are provided for closing and sealing the lid forming portions subsequent to the placement of one or more articles onto the base portion of the open-mouthed container and to the bringing together of the free ends of the material web so that cohesive regions of the web are brought together across their free surfaces and sufficient force is applied thereto to activate the adhesive and secure the or each article within the article retaining web.

BRIEF DESCRIPTION OF THE DRAWINGS

The invention will now be described more particularly with reference to the accompanying drawings which show, by way of example only, one embodiment of container blank and method of forming a shipping pack from a container blank in accordance with the invention. In the drawings.

DETAILED DESCRIPTION OF THE PREFERRED EMBODIMENT

Figure 1:
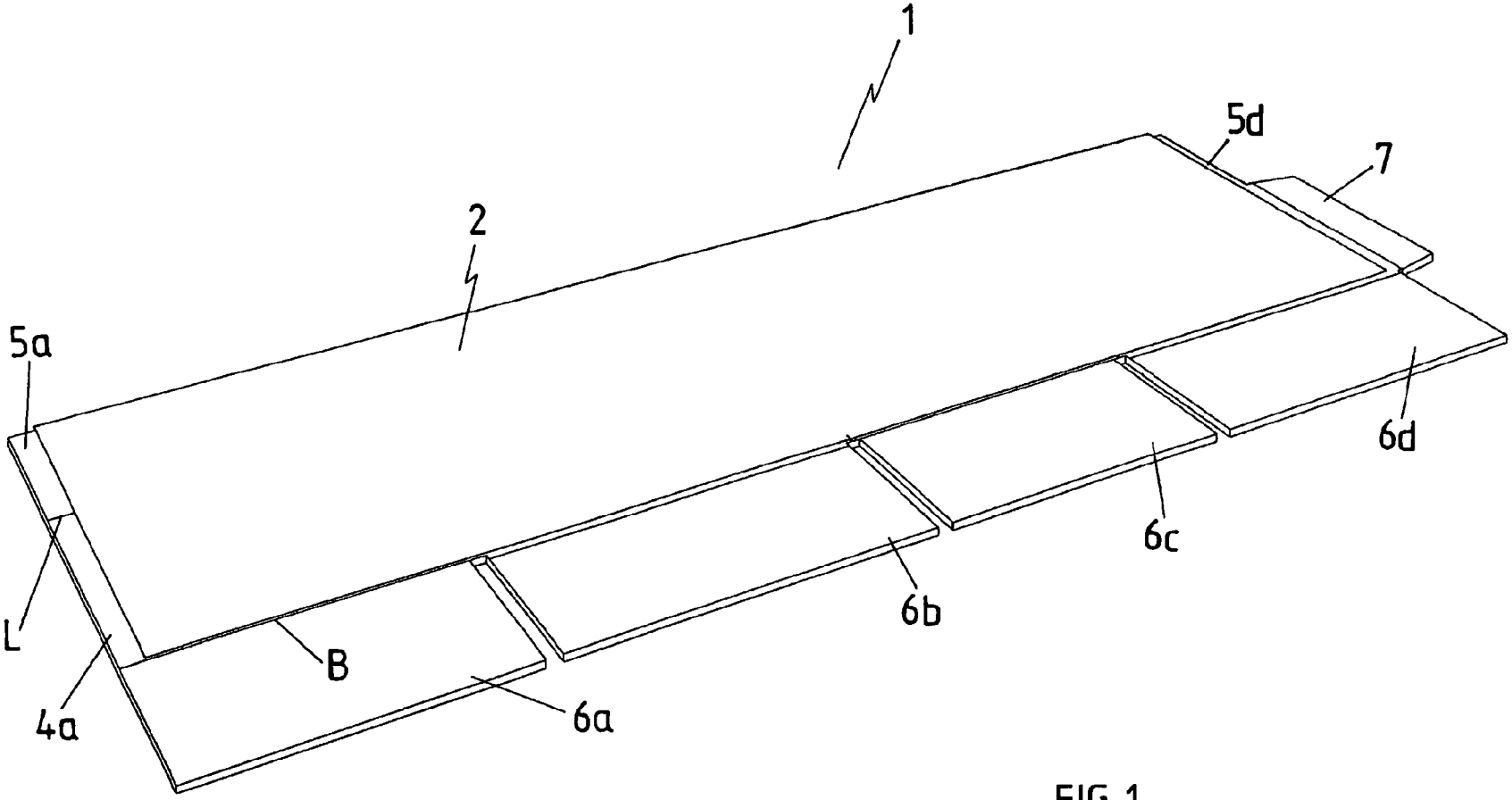
FIG. 1 is a perspective view of a standard RSC container blank having a cohesive web of material provided thereon.
Figure 2:
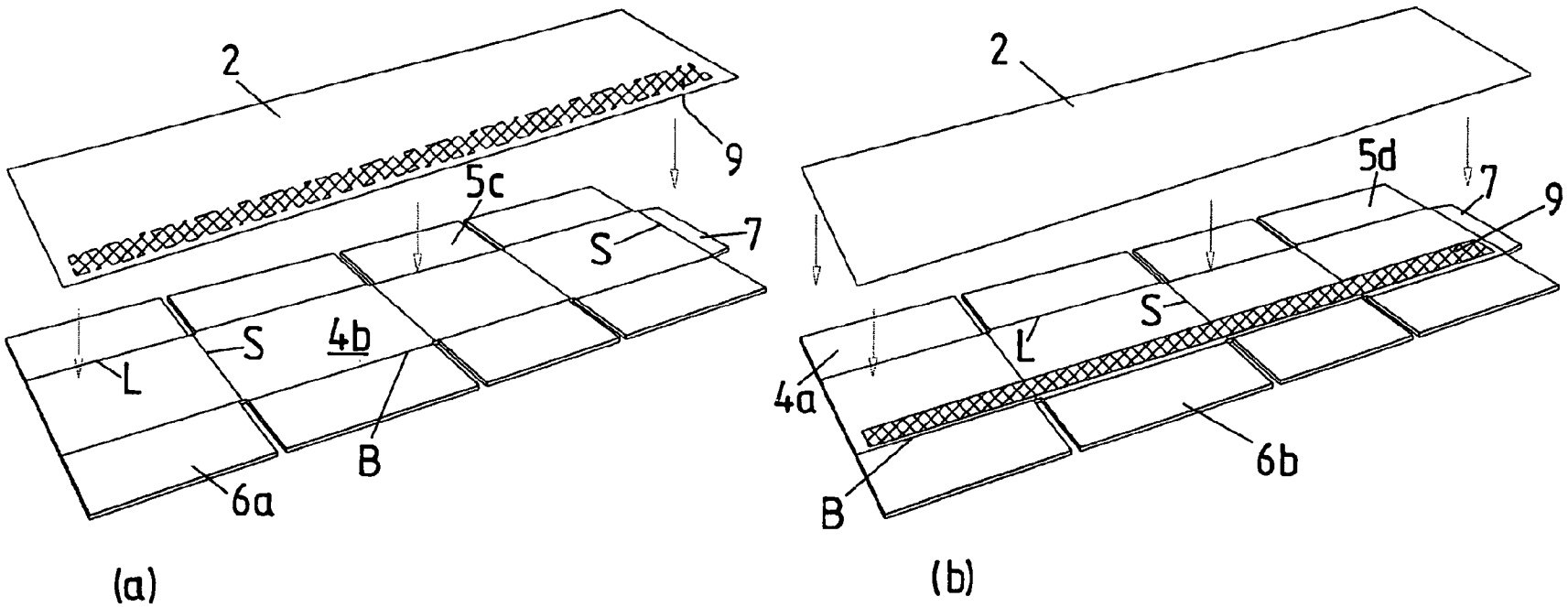
FIGS. 2*a* and 2*b* are perspective views of a container blank illustrating a first method of securing a material web to the RSC blank.
Figure 3:
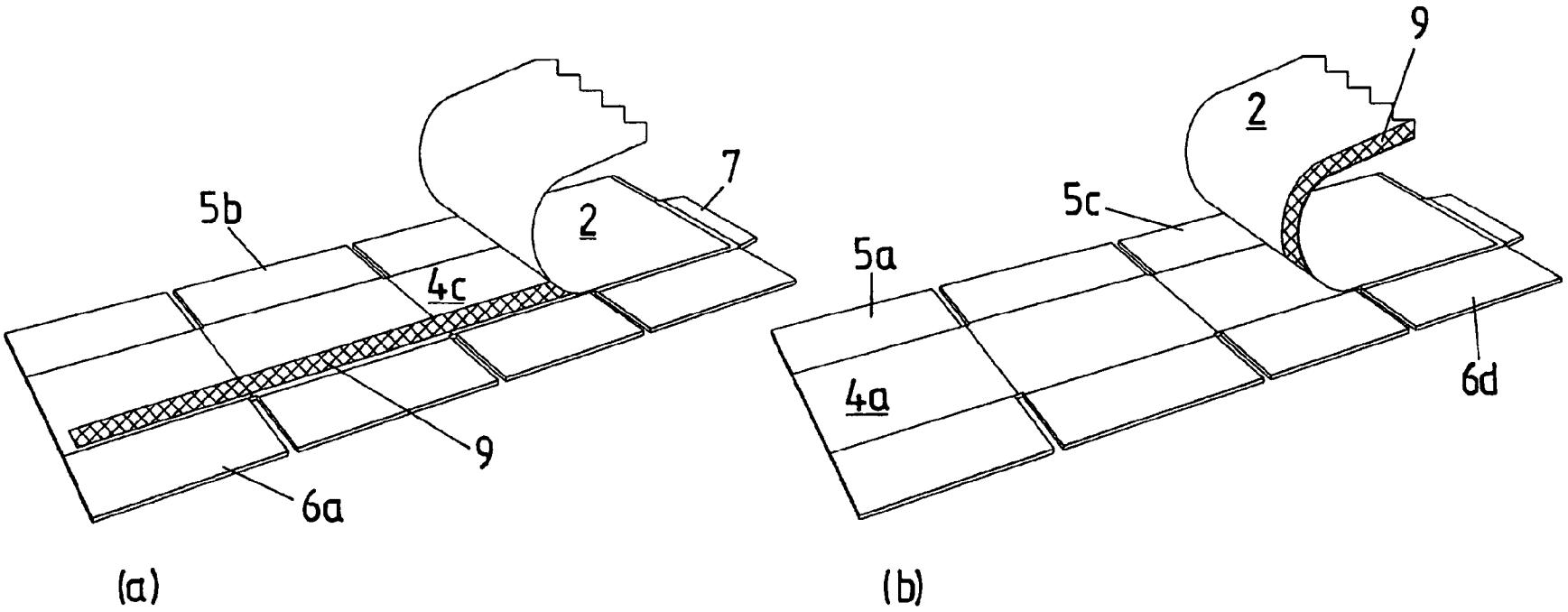
FIGS. 3*a* and 3*b* are perspective views of a container blank illustrating a second method of securing a material web to the RSC blank.

Referring to the drawings and initially to FIGS. 1 to 3, a RSC type container blank 1 is cut from craft card or cardboard and includes a flexible card or paper web 2 which is secured by adhesive to side wall forming portions 4*a*,4*b*,4*c*,4*d* and overlying lid forming elements 5*a*,5*b*,5*c*,5*d*. As will be seen from FIGS. 2 and 3, the material web is bonded to the container blank along a line closely adjacent a fold line B joining base forming elements 6*a*,6*b*,6*c*,6*d* to the corresponding side wall forming portions 4*a*,4*b*,4*c*,4*d*. The lid forming elements 5*a*,5*b*,5*c*,5*d* join the sidewall forming portions along a fold line L and each side wall portion is joined to at least one other adjacent side wall portion along a fold line S. A tab 7 is provided on one of the free end side wall portions 4*d* to facilitate securing the two free end side wall portions 4*a*,4*d* together.

Referring particularly to FIGS. 2*a* and 2*b*, the card or paper web 2 may be secured to the container blank by providing a glue line 9 either on one side of the paper web 2 or in a line or track on the side wall forming regions 4*a*,4*b*,4*c*,4*d* of the container blank 1 adjacent said base fold lines B. In either case, the material web is pressed into contact with the RSC style container blank and pressure applied equally across the entire glue line 9 to secure the web in place.

Referring now to FIGS. 3*a* and 3*b*, in a similar arrangement to that shown in FIGS. 2*a* and 2*b*, a line of adhesive 9 may be applied either directly to the container blank or to the paper web 2, before the web is brought into contact with the container blank. In this arrangement, the web is rolled onto the container blank 1 and a downward force may be applied along the adhesive region by a pressure roller.

The container blank is most easily described as a series of four segments, each having a side wall portion 4*a*,4*b*,4*c*,4*d* to which there is attached along respective fold lines B,L, a base element 6*a*,6*b*,6*c*,6*d* and a lid element 5*a*,5*b*,5*c*,5*d*. Each segment is joined to at least one adjacent segment by a side wall fold line S, and at one end there is provided a fixing tab 7 for securing the free end segments together to present a rectangular tube, which will have the material web 2 lining the inner surface thereof.

Figure 4:
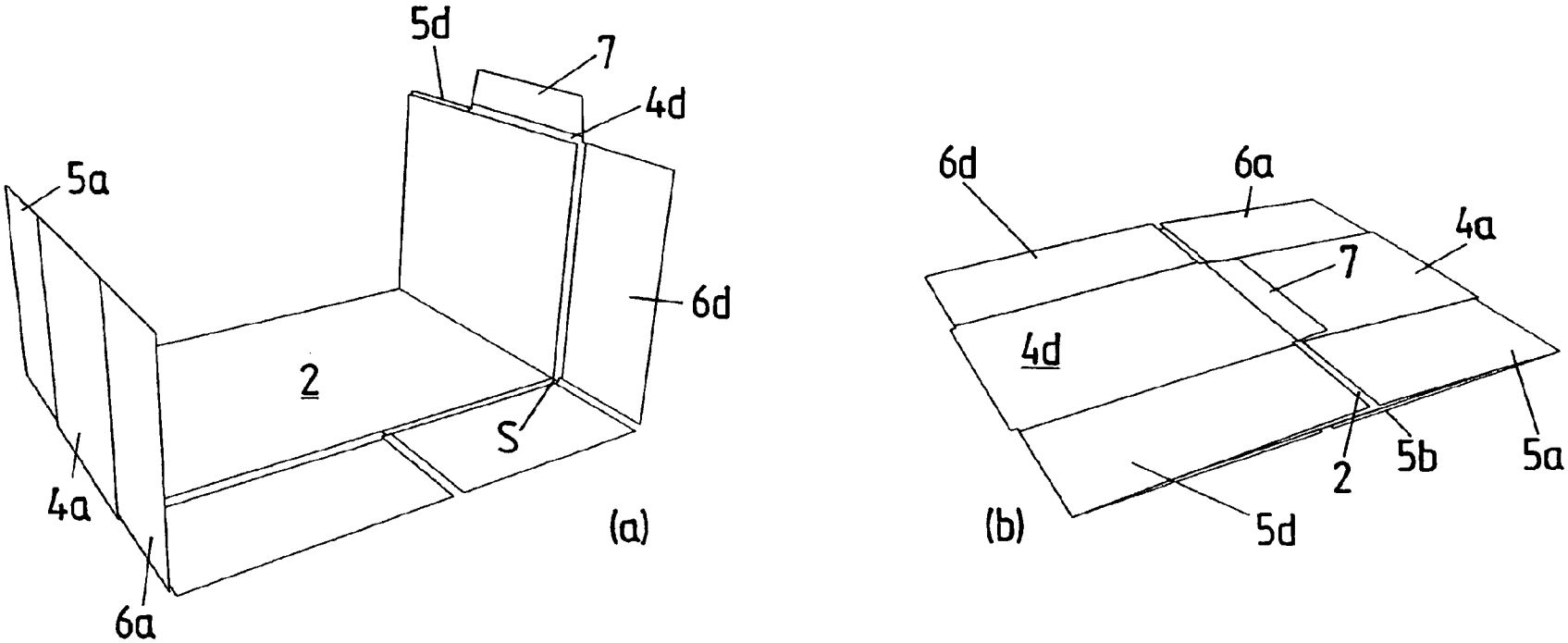
FIGS. 4*a* and 4*b* are perspective views of a lined container blank illustrating one method of folding to protect the cohesive material web during handling or conveying.

Although the container blanks may be handled or conveyed in an open configuration, it is ideally folded so that the material web 2 is not exposed prior to being assembled into an open-mouthed container. As shown in FIGS. 4*a* and 4*b*, the free end segments 4*a*,5*a*,6*a*; 4*d*,5*d*,6*d* can be folded inwardly over their respective fold lines S to overlie the inner segments 4*b*,5*b*,6*b*; 4*c*,5*c*,6*c*, thereby presenting a substantially flat blank in the form illustrated in FIG. 4*b*. Alternatively, the rectangular tube configuration described hereinabove may be formed and the tube may then be flattened to provide a lined blank similar to that shown in FIG. 4*b* for subsequent handling or conveying.

Figure 5:
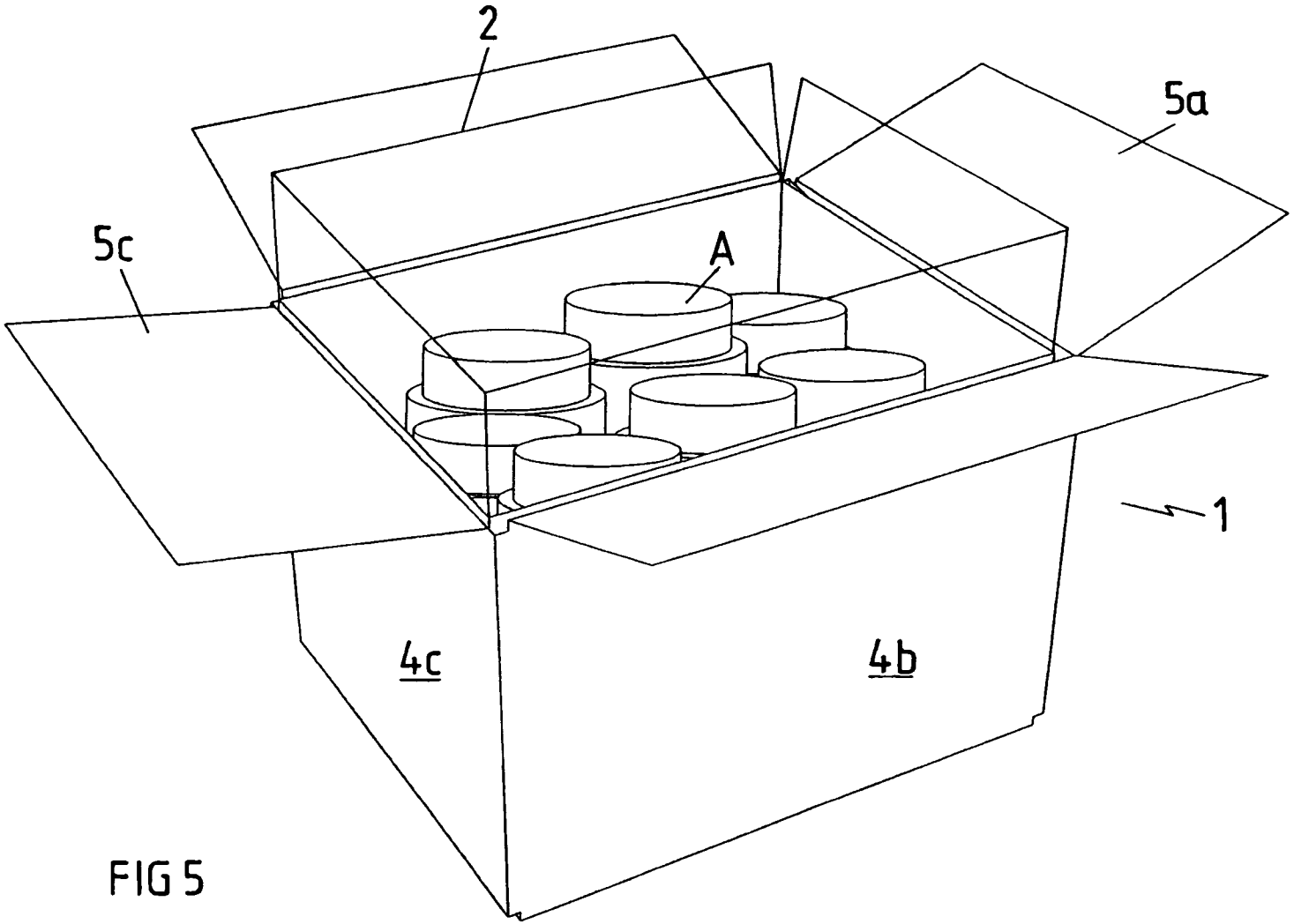
FIG. 5 is a perspective view of an open-mouthed container formed from the blank having articles for dispatch therein.
Figure 6:
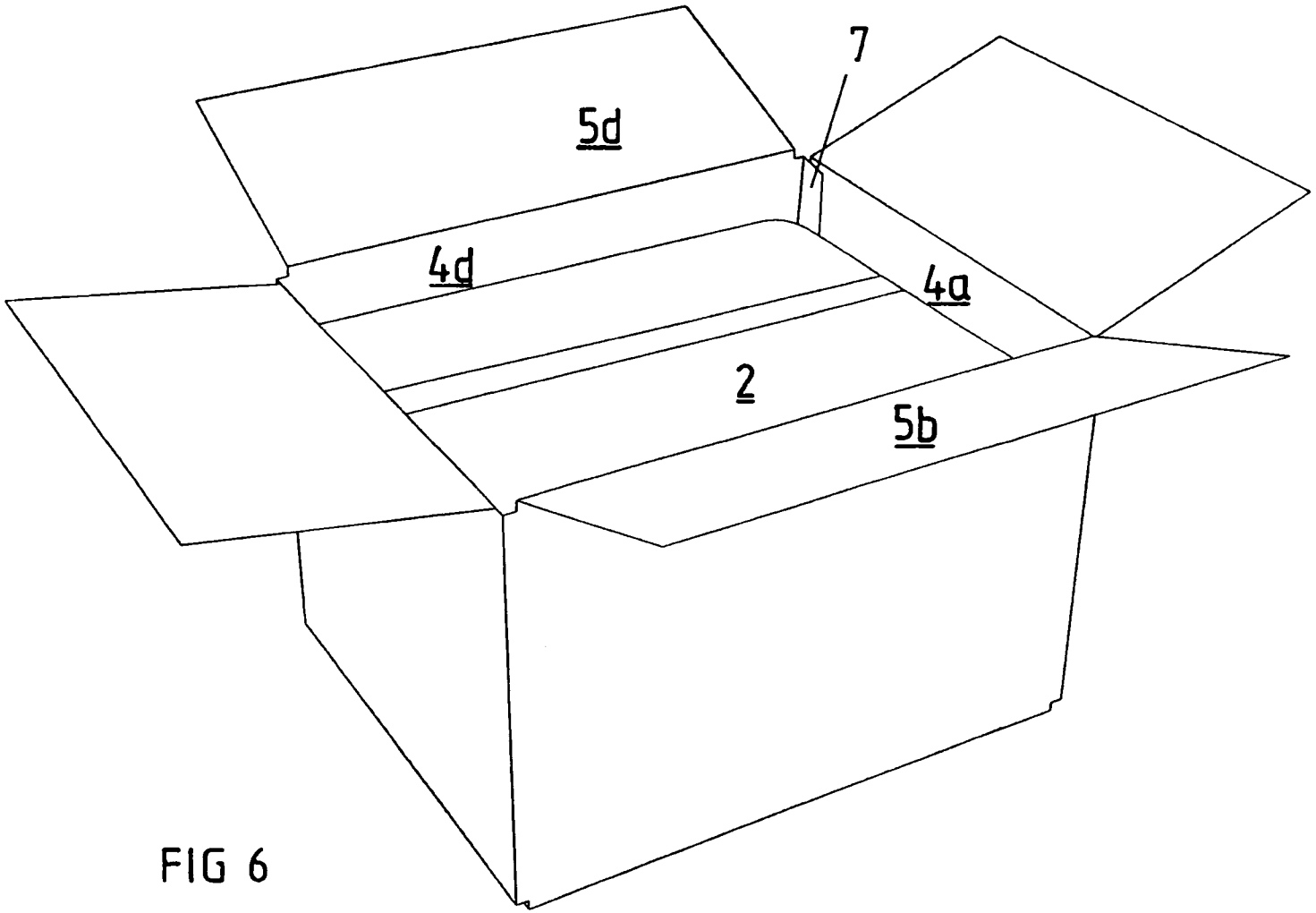
FIG. 6 is a perspective view similar to that of FIG. 5 where the web material has been tensioned over the articles and is now ready for closing and sealing of the lid portions.

With reference to FIGS. 5 and 6, an open-mouthed container may be formed from the container blank 1 by folding two opposed base forming elements 6*a*,6*c* inwardly (normally this would be the shorter base elements corresponding to the shorter sides, where applicable) and subsequently folding the remaining two opposed base forming elements 6*b*,6*d* inwardly and securing said elements in position to form a base portion. The open-mouthed container may then be used to place and secure an article A onto the base portion by bringing together the free ends of the material web so that cohesive regions of the web are brought together across their free surfaces and sufficient forces applied thereto to active the adhesive. The material may be either folded and pressed into position or "scrunched" to provide tension across the articles retained within the container. In a similar manner to how the base portion was formed, the two shorter opposing lid forming elements 5*a*,5*c* are closed inwardly over the retained articles A before the remaining lid elements 5*b*,5*d* are folded and secured. Both the base portion and the lid portion may be secured using adhesive tape or pre-applied pressure-sensitive adhesive is used to bond the elements together.

It will be appreciated by the skilled addressee that the use of flexible card or paper as the material web provides the major advantage of the present invention, in that the container is entirely recyclable rather than extra costs being incurred in packaging levies and recycling costs which is now predominant with packaging using multiple material types or materials which can not be recycled at the same time or same process.

Figure 7:
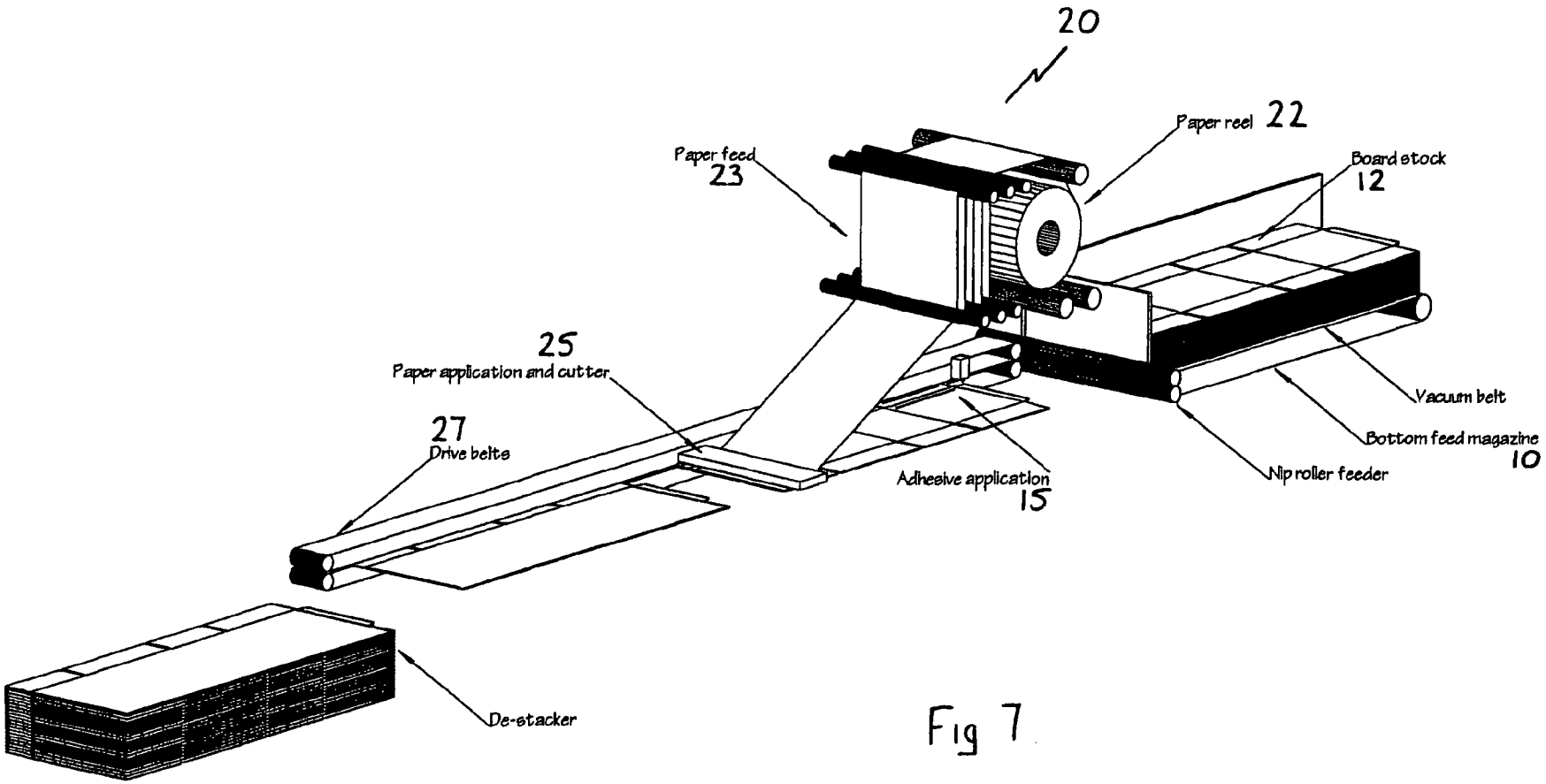
FIG. 7 is a perspective elevation of a container blank forming part of the apparatus of the invention.

Finally with reference to FIG. 7 of the accompanying drawings, an apparatus for forming a shipping pack from a container blank comprises:

- a magazine 10 from which unlined container material 12 is fed;
- an adhesive application station 15;
- a material web feeding mechanism 20 including a paper reel 22 and an accumulator 23;
- an application station 25 where the web material is adhered to the container material 12 to form a container blank;
- a conveyor means 27; and
- a folding station where free end segments of the blank are folded along their respective fold lines and are secured together by a fixing tab.

Cardboard container stock 12 is loaded onto a bottom feed magazine 10 where it is gripped by a vacuum belt and introduced via a nip roller feeder to the adhesive application station 15 where a glue gun applies' a predetermined pattern of adhesive to the cardboard stock. A web of light card or paper is drawn from a paper reel into an accumulator from where, under process control, it is aligned with the container stock. At the application station 25, the paper is adhered to the stock material and cut to length to form a container blank of the invention.

Drive belts convey the container blank either to a de-stacker (as shown) for storage or placing into a magazine or directly to a folding or folding and forming station. In one arrangement, the free end segments of the container blank are brought together to form a tube when the fixing tab 7 is secured to the opposite free segment and from this profile an open-mouthed container is formed by engaging means for bringing together opposed base forming regions and subsequently folding the two remaining opposed base forming regions inwardly and securing said remaining regions in position to form a base.

Alternatively, the end segments are folded inwardly over their respective fold lines to overlie inner segments of the blank and are secured together in a flattened configuration by the fixing tab for subsequent sale or storage for later use.

As will be familiar to the skilled addressee, means are provided for closing and sealing the lid forming portions subsequent to the placement of one or more articles onto the base portion of the open-mouthed container and to the bringing together of the free ends of the material web so that cohesive regions of the web are brought together across their free surfaces and sufficient force is applied thereto to activate the adhesive and secure the or each article within the article retaining web.

It will of course be understood that the invention is not limited to the specific details described herein, which are given by way of example only, and that various modifications and alterations are possible within the scope of the appended claims.

The invention claimed is:

1. A container blank which comprises:

a series of four segments, each having a side wall portion to which there is attached, along respective fold lines, a base element and a lid element, the segments being joined to at least one other segment by a side wall fold line; and a web of material adapted to line the blank and, in an erected configuration, is tensioned to retain an article within the container, wherein the material web comprises a unitary sheet secured along its length to each of the segments adjacent the respective side wall fold lines so that, in the erected configuration, adhesive carrying portions of the material web overlie one another and are tensioned intimately against one or more articles to secure said articles therewithin, the web being selected from one or more materials having substantially identical recycling characteristics to the material from which the blank is formed, and wherein the blank has a substantially regular elongate rectangular profile which is configurable as a flat stackable lined blank.

2. A container blank according to claim 1, in which the web material is sized and shaped so as not to extend beyond the periphery of the profile of the blank, thereby minimising snagging and facilitating increased throughput.

3. A container blank according to claim 1, in which the material web is so sized and shaped as to extend beyond the mouth of an open-mouthed container formed from the blank.

4. A container blank according to claim 1, in which the container blank is configured as a regular slotted container (RSC) type container blank in which the web of material is secured thereto over at least part of the side wall forming portions and extending over at least a major part of the lid forming elements of each segment.

5. A container blank according to claim 1, in which the material adapted to retain an article within the container formed from the blank is a card or paper web.

6. A container blank according to claim 1, in which the material web forms an article retaining profile, around the article, the material web then being closed and tensioned to secure the article against the base of the container.

7. A container blank according to claim 1, in which the material web has cohesive portions thereon, the portions being brought together so that the cohesive regions bond across their entire free area until the bonded section abuts the upper surface of the or each article held therein, thereby creating the constraining tension to the article(s).

8. A container blank according to claim 7, in which the cohesive portion includes an adhesive adapted to adhere only to surfaces having like adhesive thereon.

9. A container blank according to claim 7, in which the cohesive portions are spray coated with a cold-seal adhesive.

10. A container blank according to claim 1, in which an adhesive strip is applied to the blank and the material web is adhered to the blank by the strip.

11. A container blank according to claim 1, in which an adhesive strip is formed on the material web.

12. A container blank according to claim 9, wherein the material web is secured to each of the side wall portions.

13. A container blank according to claim 1, wherein the material web is secured to each of the base elements.

14. A method of forming a shipping pack from a container blank of the type claimed in claim 1 having attached thereto a material web adapted to retain an article within a container formed from the blank, the material web being selected from one or more materials having substantially identical recycling characteristics to the material from which the blank is formed, the method comprising:

assembling an open-mouthed container from a container blank by folding two opposed base forming regions inwardly and subsequently folding the remaining two opposed base forming regions inwardly and securing said remaining regions in position to form a base portion;

placing one or more articles onto the base portion of the open-mouthed container;

bringing together the free ends of the material web so that cohesive regions of the web are brought together across their free surfaces and sufficient force is applied thereto to activate the adhesive and secure the or each article within the article retaining web;

closing the lid portions in an overlying relationship and sealing the lid.

15. A method of forming a shipping pack as claimed in claim 14, in which the base portion and the lid are secured using adhesive tape.

16. A method of forming a shipping pack as claimed in claim 14, in which pre-applied pressure-sensitive adhesive is used to bond the base forming regions and the lid forming regions respectively together.

17. A method of forming a shipping pack according to claim 14, the material web having cohesive regions and being cut along its fold lines, the free ends of two opposed web segments are brought together to overlie the or each article before the remaining cohesive regions are brought together and tension applied.

18. A method of forming a shipping pack as claimed in claim 14, further comprising the step of folding the container blank so that the material web is not exposed prior to assembling the open-mouthed container.

19. A method of forming a shipping pack according to claim 18, wherein free end segments of the container blank are folded inwardly to overlie corresponding inner segments, thereby presenting a substantially flat stackable blank, for storage or subsequent container assembly.

20. A method of forming a shipping pack according to claim 19, wherein free end segments are secured together to present a rectangular tube having the material web lining the inner surface thereof, the tube being then flattened to provide a stackable lined blank for handling or conveying.

21. An apparatus for forming a shipping pack from a container blank of the type claimed in claim 1 having attached thereto a material web adapted to retain an article within a container formed from the blank, the material web being selected from one or more materials having substantially identical recycling characteristics to the material from which the blank is formed, the apparatus comprising:

a magazine from which unlined container material is fed;

an adhesive application station;

a material web feeding mechanism;

an application station where the web material is adhered to the container material to form a container blank;

a conveyor means; and a folding station where free end segments of the blank are folded along their respective fold lines and are secured together by a fixing tab.

22. An apparatus for forming a shipping pack according to claim 21, in which means are provided to fold the end segments inwardly over their respective fold lines to overlie inner segments of the blank, the end segments being secured together in a flattened configuration by adhesive present on said fixing tab.

23. An apparatus for forming a shipping pack according to claim 21, in which there is provided means for forming an open-mouthed container from a lined container blank including means for bringing together opposed base forming regions and subsequently folding the two remaining opposed base forming regions inwardly and securing said remaining regions in position to form a base.

24. An apparatus for forming a shipping pack according to claim 23, in which there is provided means for closing and sealing the lid forming portions subsequent to the placement of one or more articles onto the base portion of the open-mouthed container and to the bringing together of the free ends of the material web so that cohesive regions of the web are brought together across their free surfaces and sufficient force is applied thereto to activate the adhesive and secure the or each article within the article retaining web.

* * * * *